United States Patent [19]

Wenzel et al.

[11] 4,190,135

[45] Feb. 26, 1980

[54] GEAR RACK HOIST

[75] Inventors: Joerg Wenzel; Erich Mai, both of Kirschfurt, Fed. Rep. of Germany

[73] Assignee: Josef Haamann, Fed. Rep. of Germany

[21] Appl. No.: 882,100

[22] Filed: Mar. 1, 1978

[51] Int. Cl.[2] ..... B66B 9/00

[52] U.S. Cl. ..... 187/1 R

[58] Field of Search ..... 187/2, 1, 19; 214/654, 214/653, 651; 414/619, 621, 622

[56] References Cited

U.S. PATENT DOCUMENTS

| | | | |
|---|---|---|---|
| 1,505,810 | 8/1924 | Schuh | 187/19 |
| 2,483,109 | 9/1949 | Smith | 214/653 |
| 2,726,781 | 12/1955 | Stanley | 214/653 |

*Primary Examiner*—Joseph F. Peters, Jr.

*Assistant Examiner*—Milton L. Smith

*Attorney, Agent, or Firm*—Jacobi, Lilling & Siegel

[57] ABSTRACT

A gear rack hoist for lifting, lowering and/or holding containers or the like having upper and lower corner fittings that are adapted to be engaged by conical parts of two beams mounted in spaced relation on a hoist shaft. The beam associated with the lower fitting is provided with two bars of different lengths, the bars being pivotally connected to the hoist shaft and to a conical part. Preferably, the total length of the two bars is less than or does not exceed significantly the height of the hoist shaft. The longer bar is connected to the hoist shaft by an outwardly closed, generally U-shaped suspension and securing bail surrounding the bar with play and extending generally transversely to the hoist shaft. The ball is provided with a guide and support for a support bolt secured to the upper end of the longer bar.

4 Claims, 5 Drawing Figures

GEAR RACK HOIST

BACKGROUND OF THE INVENTION

The invention relates to a gear rack hoist for lifting, lowering and/or holding containers, cabins, shelters, temporary construction etc., comprising corner fittings that operate in concert with the conical engaging parts of two beams spaced in the hoist shaft and associated with the upper and lower corner fittings, the beam associated with the lower one being provided with two bars of different lengths, one of said bars being connected to the hoist shaft, the other to the conical engaging part, both in articulating manner by means of bolts, the total length of these two bars not exceeding significantly or at all the height of the hoist shaft.

German Pat. No. 2,540,400 discloses this type of gear hoist. Such a hoist offers among others the advantage that upon complete insertion of the two bars of the lower beam, these bars are simply folded against the hoist shaft where they can be so fixed, for instance, by means of a clamping bail so that they form one integral unit with the hoist shaft for moving and storage. Whether there are several connecting points at the hoist shaft for the longer bar of the lower beam which assumes an oblique position with respect to said hoist shaft when in its operational position, where said connecting points are some distance apart from each other, (corresponding to the disclosure of German Pat. No. 2,540,400), or whether there is only one such connecting point, such a gear rack hoist shaft suffers from the risk that the bar of the lower beam slanting upward against the hoist shaft easily tips forward if the securing pin is removed, in the course of erection or dismantling, so that the operators might be injured. The significance of this danger can be properly gauged when considering that such gear hoists as a rule are several meters high.

SUMMARY OF THE INVENTION

The invention, therefore, addresses the problem of eliminating the danger cited above, that is, to take steps with respect to a gear rack hoist of the initially cited kind, which eliminate tipping forward of the upper bar of the lower beam when erecting or dismantling the hoist and which furthermore facilitate handling the gear hoist by eliminating securing pins in the vicinity of the lower beam.

The invention solves this problem for a gear rack hoist of the initially cited design in that the connecting point to the hoist shaft for the longer bar of the lower beam, which takes a slanted upward position toward said shaft when in the operational position, consists of a U-shaped suspension and securing bail closed to the outside and surrounding said bar with play transversely to said shaft, said bail furthermore being provided with guidance and support for the bolt fastened to the upper end of the bar. This outwardly closed suspension and securing bail surrounds the upper bar of the lower beam in every position and thereby eliminates reliably the dangers cited initially attending both the erection and the dismantling of the gear hoist. After the hoist has served its purpose, both bars of the lower beam may be tipped against the hoist shaft and brought into an approximately straight storage position, the upper end of the longer bar of the lower beam being easily pushed through the suspension and securing bail because of a suitably selected amount of play transverse to the axis.

On the other hand, the setting of the lower beam into its operational position is facilitated in that, upon detaching for instance a clamping bail, or similar fastening means, the two bars of the lower beam need merely be pulled out of the hoist shaft, the support bolt at the upper end of the longer bar of the lower beam being automatically inserted or suspended through the guidance of the suspension and securing bail into the support forming the connecting point to the jacking shaft. The plug-in pin previously required for connection is thus eliminated.

The suspension and securing bail may be in the form of a bracket which may advantageously be made by casting or molding.

If the gear hoist must be provided with several connecting points spaced apart from one another for the longer bar of the lower beam extending at a slant upward against the hoist shaft when in its operational position, a further embodiment of the invention provides the suspension and securing bail with end plates extending in the axial direction of the jack and comprising a series of support pockets with associated slanted surfaces, the suspension and securing bail being outwardly closed only with respect to the lowermost slanted surfaces while being outwardly and upwardly open over its remaining part. This allows hooking the bilaterally protruding support bolt of the upper end of the longer bar of the lower beam selectively into variously positioned support pockets, namely depending on the particular height of the container etc. for which the gear rack is to be used. In such a case, the longer bar of the lower beam is secured against tipping forward.

When the gear hoist is provided with end plates at the upper end of the hoist shaft for detachably securing the upper beam, and if the two bars of the lower beam are of such total length that for a straight storage position of said bars of the lower beam—in which they are tight against the hoist shaft—the upper end of the longer bar of the lower beam can be held in detachable manner by these end plates, then apropriately these end plates are made flush with the suspension and securing bail and are provided with clearances or slots open on the downside and parallel to the hoist shaft, said clearances or slots serving to latch and hold the protruding ends of the support bolt fastened to the upper end of the longer bar, when the bars of the lower beam are brought into the approximate storage position. This further simplifies handling of the gear rack hoist, because again the previously required support bolt for stopping the upper end of the longer bar of the lower beam in its storage position now becomes superfluous and the fixation of the end of the bar takes place automatically when the bars are tipped against the hoist shaft.

BRIEF DESCRIPTION OF THE DRAWINGS

The invention is described below in further detail in relation to the drawings and embodiments.

DESCRIPTION OF THE PREFERRED EMBODIMENTS

Figure 1:
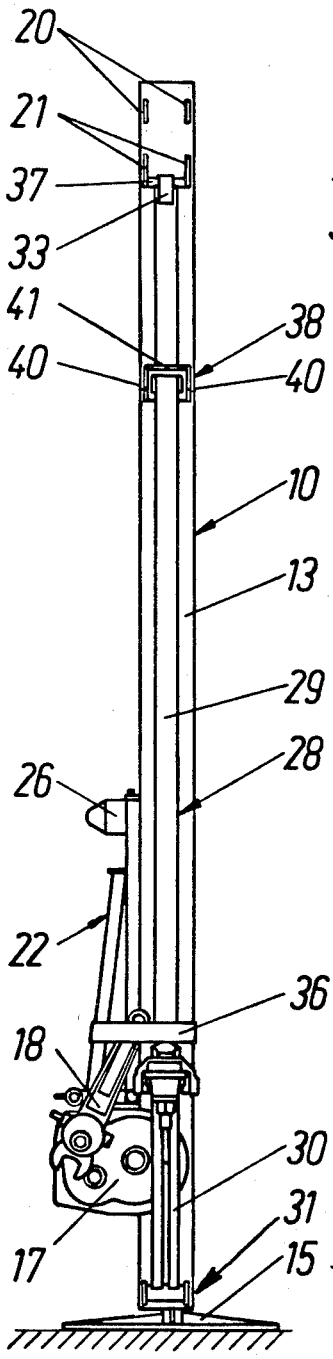
FIG. 1 is a front elevational view of the gear rack hoist of the invention, showing the bars of the lower beam in their folded position, the upper beam and the hand crank of the crank-drive of the hoist being shown also in their storage position against the hoist shaft.
Figure 2:
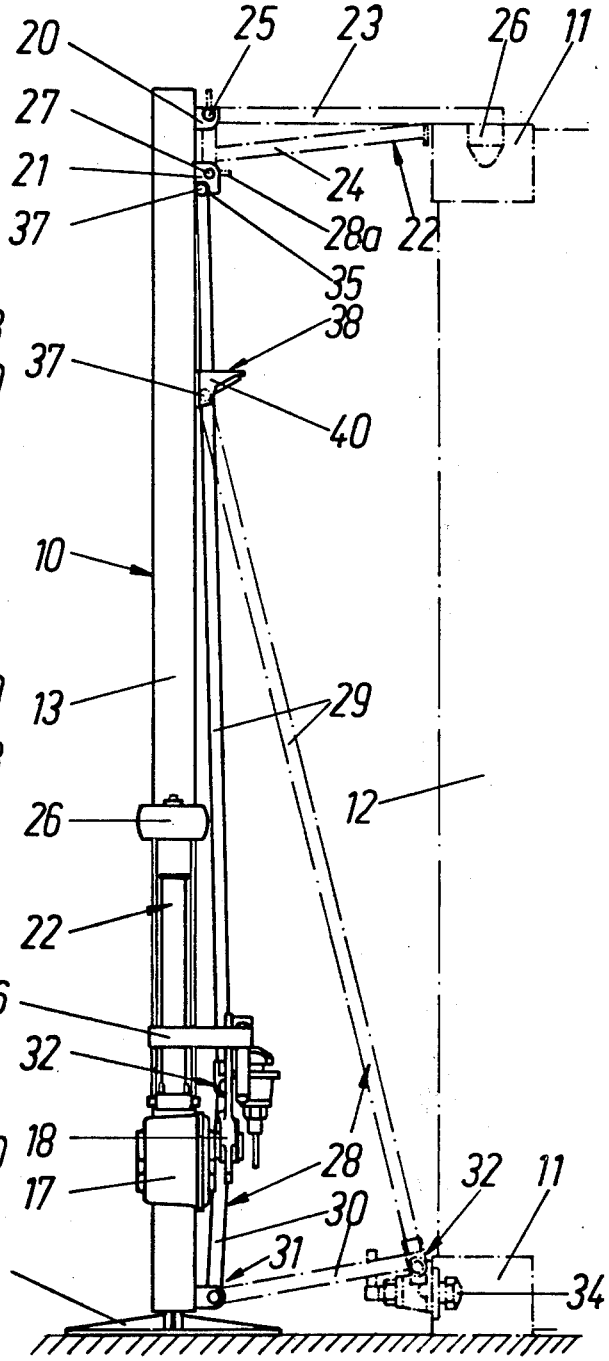
FIG. 2 is a side elevational view of the gear hoist shown in FIG. 1, the broken lines indicating the gear hoist seizing a container.

FIGS. 1 and 2 show the gear-rack hoist in the storage or moving condition in which the two beams inclusive of the band crank are consolidated into one compact unit together with the remaining parts of the gear-rack hoist. Such hoists are used to handle containers or the like and, to that end, four similar gear-rack hoists 10 are applied against the standardized corner fittings 11 of, for instance, a container 12. Gear-rack hoist 10 comprises a hoist shaft 13 and a gear-rack (not shown) guided in said shaft and provided with a resting foot 15 and also with a crank drive 17 mounted on said shaft 13 which may be actuated by a plug-on manual crank 18 in order to move hoist shaft 13 upward or downward along the gear-rack resting on the ground.

Two pairs of securing side plates 20 and 21 are mounted on the upper end of hoist shaft 13 to allow for detachably fastening an upper beam 22 to said shaft. The securing side plates 20 are provided with upwardly open clearances for seating a lockable securing pin 25. Locking bolts 27 may be inserted into bores of the securing side plates 21, said bolts 27 being axially displaceable and guided in upper beam 22 and pre-stressed by an inserted spring. Handles 28*a* are used to make securing bolts 27 snap into the corresponding bores in the securing side plates 21. An upper beam 22 consists of two bars 23 and 24 of different lengths, the former comprising a conical actuating part 26 at its free end, said part 26 extending axially parallel to the hoist and engaging an upper corner fitting 11 from above.

A lower beam 28 associated with the lower corner fittings 11 of container 12 consists of two bars 29 and 30 of different lengths. The shorter bar 30 is connected at 31 to the hoist shaft 13 and at 32 to a conical actuating part 34 extending substantially perpendicularly to the hoisting axis and to the side of it into one of the lower corner fittings 11. The lower end of the longer bar 29 is also connected at 32 to actuating part 34. A support bolt 37 is rigidly fastened to the upper end of bar 29 by means of a bail 33, said bolt projecting on both ends. When bars 29 and 30 are in their approximately straight storage position, shown in solid lines in FIGS. 1 and 2, support bolt 37 penetrates the downwardly open clearances of securing side plates 21, whereby the upper end of bar 29 of the lower beam is fixed. A clamping strip 36 keeps bars 29 and 30 in their approximately straight storage position and similarly holds also upper beam 22 and hand crank 18, as explained initially. Clearances 35 are parallel to the hoisting axis and are chosen long enough to provide play between support bolt 37 and the upper end of the clearances for the purpose of meeting deviations due to tolerances.

In order to move the gear-rack hoist 10 against the container 12 in the manner shown in broken lines in FIG. 2, clamping strip 36 is first removed and then the upper beam 22 is fastened to side plates 20 and 21 by means of securing pin 25 and the two locking bolts 27. Thereafter, the lower beam 28 is moved into the operational position by removing bars 29 and 30 from hoist shaft 13 through the intermediary of actuating part 34, the upper end of bar 29 being guided in an outwardly closed, bracket-shaped suspension and securing bail 38 and being secured against tipping to the outside.

Figure 3:
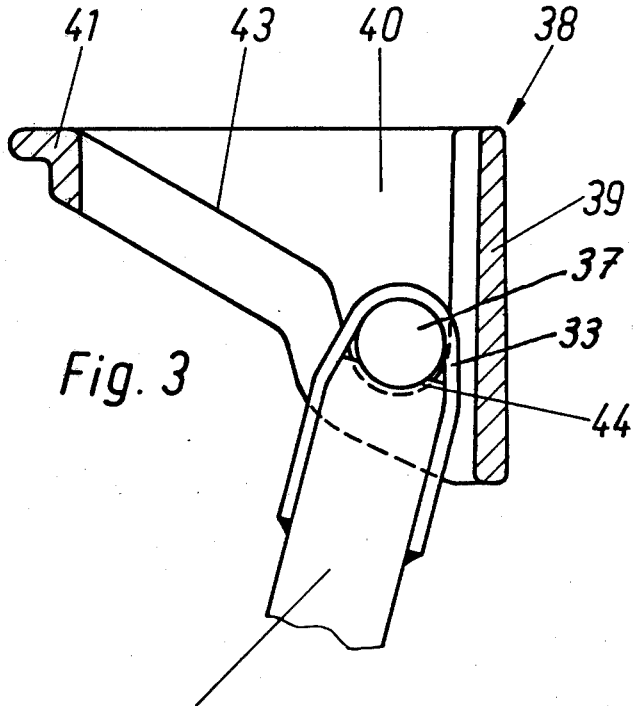
FIG. 3 is an enlarged longitudinal sectional view of the suspension and securing bail.
Figure 4:
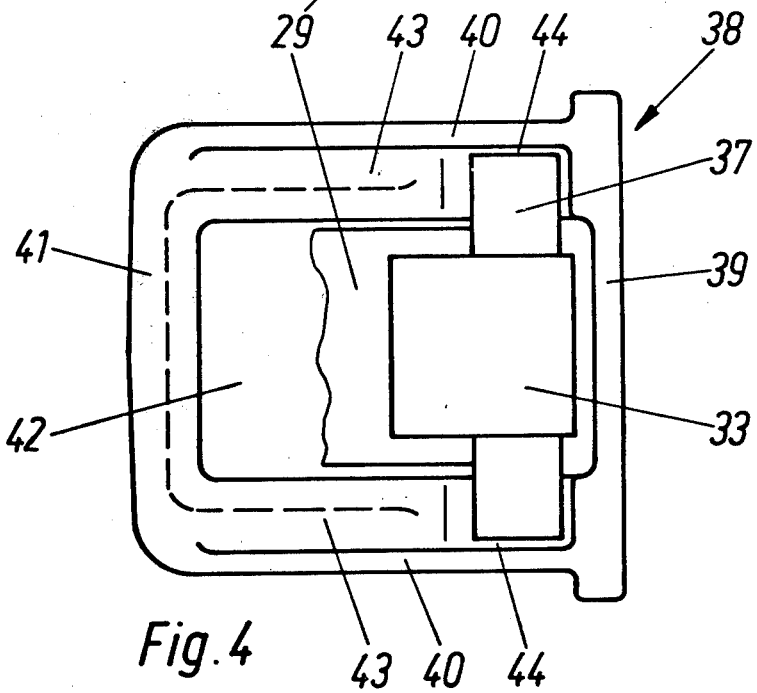
FIG. 4 is a top plan view of the suspension and securing bail of FIG. 3.

The suspension and securing bail 38, shown in one embodiment in FIGS. 3 and 4, comprises a molded or cast part rigidly connected to the hoist shaft 13. The bail 38 is provided with two opposite end plates 40 separated by a base 39 and externally connected by a brace 41, which together define an aperture 42 in which bar 29 is displacably guided. Aperture 42 to that end is sufficiently large in a direction substantially perpendicular to the hoist axis to offer the play required for the upper end of said bar, as clearly shown in FIGS. 3 and 4. Starting from the cross-brace 41, both end plates 40 are provided with slanted surfaces 43 leading to support pockets 44. When the bar 29 is pulled into the position shown in broken lines in FIG. 2, which is the operational position, the two ends of storage bolt 37 which protrude sideways from bar 29 glide downwardly on slanted surfaces 43 into support pockets 44 which form the connecting or suspension point for the upper end of bar 29. After actuating parts 26 and 34 are connecting the associated corner fittings 11 of container 12, actuation of the subject gear-rack hoist takes place in a contentional manner by means of the hand crank 18 plugged onto crank drive 17.

Upon completion of the desired operations, the upper beam 22 is detached from hoist shaft 13 and the lower beam 28 is merely tipped against hoist shaft 13 until its bars 29 and 30 assume the approximately straight position of storage shown in FIGS. 1 and 2. During this folding process, the upper end of bar 29 again is guided through the suspension and securing bail 38 until support bolt 37 snaps into position in the clearance 35 of the securing side plates 21.

Figure 5:
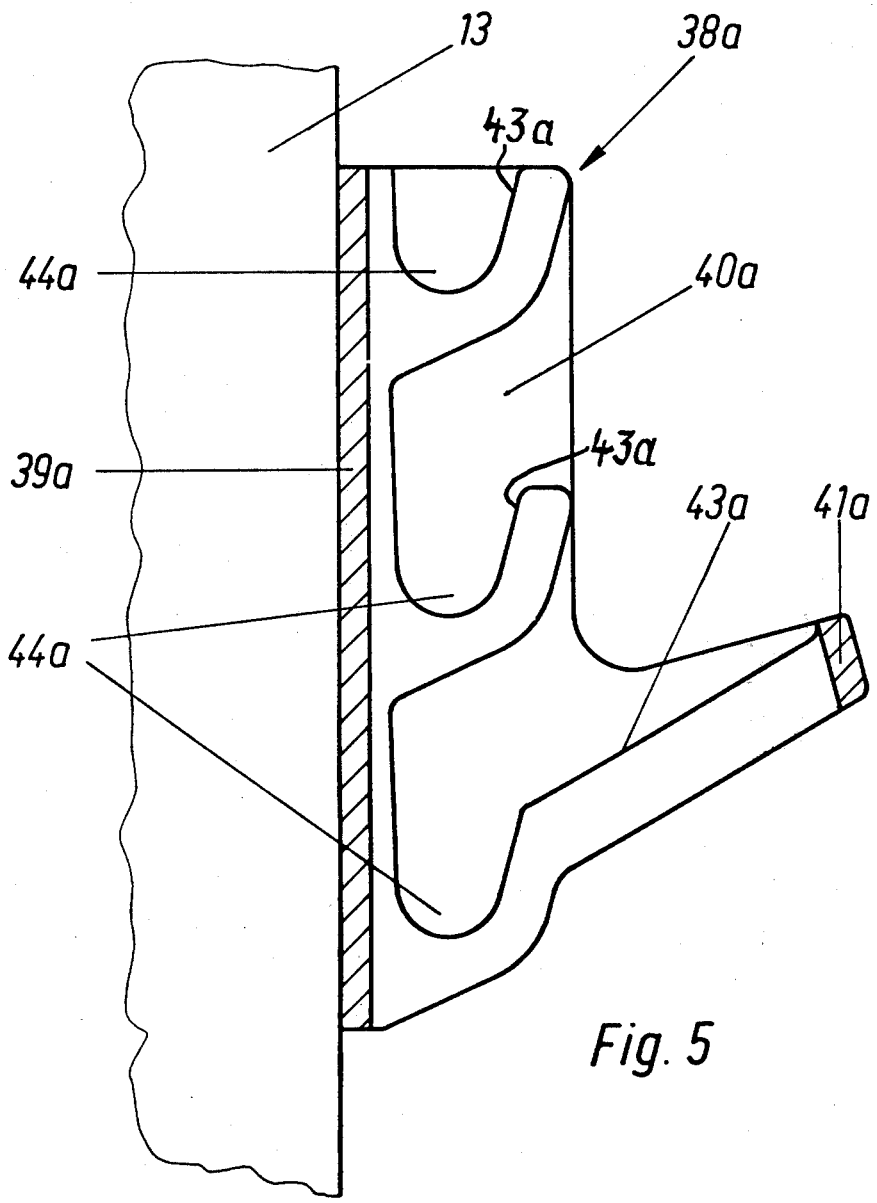
FIG. 5 is an elevational view of a modified suspension and securing bail joined to part of the hoist shaft.

FIG. 5 shows a modified suspension and securing bail 38*a* provided with several connecting or suspension points for the upper end of bar 29 of lower beam 28, so that the gear-rack hoist may be used for handling containers etc. of different heights, as described in German Pat. No. 2,540,400. In this case, the upper beam 22 must be modified in such a manner that its actuating part 26 is transversely adjustable to the hoisting shaft, again as described in German Pat. No. 2,540,400.

The suspension and securing bail 38*a* is provided with end plates 40*a* extended in the direction of the hoist and with several pairs of opposite slanted surfaces 43*a* terminating in associated support pockets 44*a* for the support bolts 37. End plates 40*a* are connected only in the lower region opposite the lower slanted surfaces 43*a* by a cross-brace 41*a* which fills the same function as cross-brace 41 in the embodiment shown in FIGS. 3 and 4. The two laterally projecting ends of support bolt 37 may always be made to engage selectively from the outside with one pair of slanted surfaces and support pockets 42*a* and 44*a*, respectively. In this case, slanted surfaces 43*a* automatically guide support bolt 37 into the associated support pockets 44*a* when bars 29 and 30 of the lower beam 28 are pulled out into the operational position.

What is claimed is:

1. In a gear rack hoist for lifting, lowering and/or supporting containers, shelters, cabins, temporary construction or the like having corner fittings which operate in concert with conical actuating parts of upper and lower hoist beams mounted in spaced relation on the hoist shaft and respectively associated with upper and lower corner fittings, the beam associated with the lower fittings being provided with two bars of different lengths each articulatedly connected by means of bolts to the hoist shaft and to the conical actuating part, the total length of these two bars not appreciably or at all exceeding the height of the hoist shaft, the improvement wherein the connecting means at the hoist shaft (13) for the longer bar (29) of the lower beam (28), where said longer bar assumes an operational position slanting upwards against the hoist shaft, comprises an outwardly closed, generally U-shaped suspension and securing bail surrounding said bar (29) with play and extending generally transversely to the hoist shaft, said bail being provided with a guide and a support pocket (44), and a support bolt (37) fastened to the upper end of said longer bar and being receivable in said support pocket.

2. In the gear rack hoist of claim 1, wherein the suspension and securing bail (38) is a bracket, said bracket being provided with opposite end plates (40) having support pockets (44) and with slanted surfaces (43) from its closed outer end to said support pockets (44) for receiving the ends of the support bolt (37) at the upper end of said longer bar.

3. In the gear rack hoist of claim 2, wherein there are provided several spaced connection points for the longer bar of the lower beam extending at a slant upwardly toward the hoist shaft when in its operational position, and an actuating part adjustable transversely to the hoist axis at the upper beam, the suspension and securing bail end plates (**40*a*) being prolonged in the axial hoist direction and being provided with a series of support pockets (44*a*) located at said spaced connection points and associated slanted surfaces (43*a*), and the suspension and securing bail (38*a***) being closed only with respect to the lowermost slanted surfaces in the outward direction and being open over the remaining part of its height both outwardly and upwardly.

4. In the gear rack hoist of claim 2 wherein there are provided side plates at the upper end of the hoist shaft for detachably fastening the upper beam, the total length of the two bars of the lower beam being such that, in an approximately straight storage position of said bars of the lower beam in which they are kept tight against the hoist shaft, the upper end of the longer bar of the lower beam is detachably held by these side plates, the side plates (21) being substantially flush with the suspension and securing bail (38) and being provided with downwardly opening clearances (32) extending substantially parallel to the hoist axis and into which snap the projecting ends of the support bolt (37) mounted to the upper end of said longer bar when bars (29, 30) of the lower beam (28) are in a stretched out storage position.

* * * * *